US005139401A

United States Patent [19]

Thompson

[11] Patent Number: 5,139,401

[45] Date of Patent: Aug. 18, 1992

[54] OSCILLATORY PUMP WITH ELASTIC DIVIDER

[76] Inventor: George A. Thompson, 114 Demotte Ave., Daytona, Fla. 32019

[21] Appl. No.: 789,377

[22] Filed: Nov. 5, 1991

Related U.S. Application Data

[63] Continuation of Ser. No. 559,235, Jul. 30, 1990.

[51] Int. Cl.[5] ..... F04C 5/00; F04C 9/00

[52] U.S. Cl. ..... 418/67; 418/155; 418/156

[58] Field of Search ..... 418/56, 67, 153, 156, 418/66, 155

[56] References Cited

U.S. PATENT DOCUMENTS

| | | | |
|---|---|---|---|
| 1,516,817 | 11/1924 | Hawkins | 418/57 |
| 1,530,973 | 3/1925 | Anderson | 418/67 |
| 2,380,283 | 7/1945 | VanRanst | 418/56 |
| 3,081,707 | 3/1963 | Marshall | 418/67 |
| 4,836,759 | 6/1989 | Lloyd | 418/56 |

FOREIGN PATENT DOCUMENTS

| | | | |
|---|---|---|---|
| 302080 | 12/1917 | Fed. Rep. of Germany | 418/66 |
| 2751384 | 5/1979 | Fed. Rep. of Germany | 418/153 |

*Primary Examiner*—Richard A. Bertsch
*Assistant Examiner*—David L. Cavanaugh
*Attorney, Agent, or Firm*—Sughrue, Mion, Zinn, Macpeak & Seas

[57] ABSTRACT

An oscillatory fluid pump is provided with a horizontally disposed cylindrical chamber disposed above and in communication with a rectilinear chamber along the entire length of both chambers. An inverted Y-shaped elastic member is secured at the lower ends of the downwardly angularly related legs to the bottom of the rectilinear chamber and the upstanding leg is secured to a cylindrical pumping member located in the cylindrical chamber. A cylindrical bore is eccentrically located along the length of the cylindrical pumping member of a drive shaft having an eccentric thereon extends through the bore and is supported at opposite ends by the housing. A bearing is located between the eccentric and the bore so that upon rotation of the shaft the eccentric will cause the cylindrical pumping member to move in a circular motion about the internal surface of the cylindrical chamber to pump fluid from an inlet in one side of the rectilinear chamber about the internal surface of the cylindrical chamber and outwardly through an outlet opening in the opposite side of the rectilinear chamber.

2 Claims, 3 Drawing Sheets

OSCILLATORY PUMP WITH ELASTIC DIVIDER

This is a continuation of application Ser. No. 07/559,235 filed Jul. 30, 1990.

BACKGROUND OF THE INVENTION

The present invention is directed to an oscillatory fluid pump, more specifically to a pump having a central cylindrical piston disposed in a larger diameter cylindrical housing and which is elastically tethered to said housing for oscillatory non-rotatable motion about the internal surface of the hollow cylindrical housing.

Rotary pumps of the type having a rotor eccentrically mounted for rotation within a hollow cylindrical housing with a plurality of radially disposed veins mounted for oscillating movement within the rotor for constant engagement with the internal circumference of the hollow cylindrical housing are old and well-known in the art. An example of such a rotary pump is disclosed in the U.S. patent to Scognamillo—U.S. Pat. No. 2,684,037.

Rotary pumps are also known in the art wherein a plurality of rollers are carried by the eccentric rotor for oscillating movement along radial paths while rolling about the internal surface of the hollow cylindrical housing. An example of a roller pump of this type is disclosed in the U.S. patent to Pareja—U.S. Pat. No. 4,284,392.

SUMMARY OF THE INVENTION

The present invention provides a new and improved oscillatory fluid pump, the moving parts of which are subjected to substantially less wear than conventional oscillatory fluid pumps.

The present invention provides a new and improved oscillatory pump comprising housing means including a horizontally disposed cylindrical chamber and a rectilinear chamber beneath said cylindrical chamber and in communication therewith, a cylindrical pumping member having an elongated horizontally disposed axis located in said cylindrical chamber and having a diameter less than said cylindrical chamber, elastic means secured to said housing in said rectilinear chamber and connected to said cylindrical pumping member along the length thereof to prevent rotation of said pumping member about its horizontal axis while permitting said cylindrical pumping member to move about the internal surface of said cylindrical chamber, said cylindrical pumping member having an eccentric bore extending therethrough, a rotatable drive shaft extending through said cylindrical chamber and said eccentric bore of said housing and having an eccentric thereon whereby upon rotation of said shaft the rotation of said eccentric about the axis of said shaft will cause said pumping member to move in a substantially circular path about the internal surface of said cylindrical chamber and fluid inlet and outlet means disposed in communication with said rectilinear chamber on opposite sides of said elastic means.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
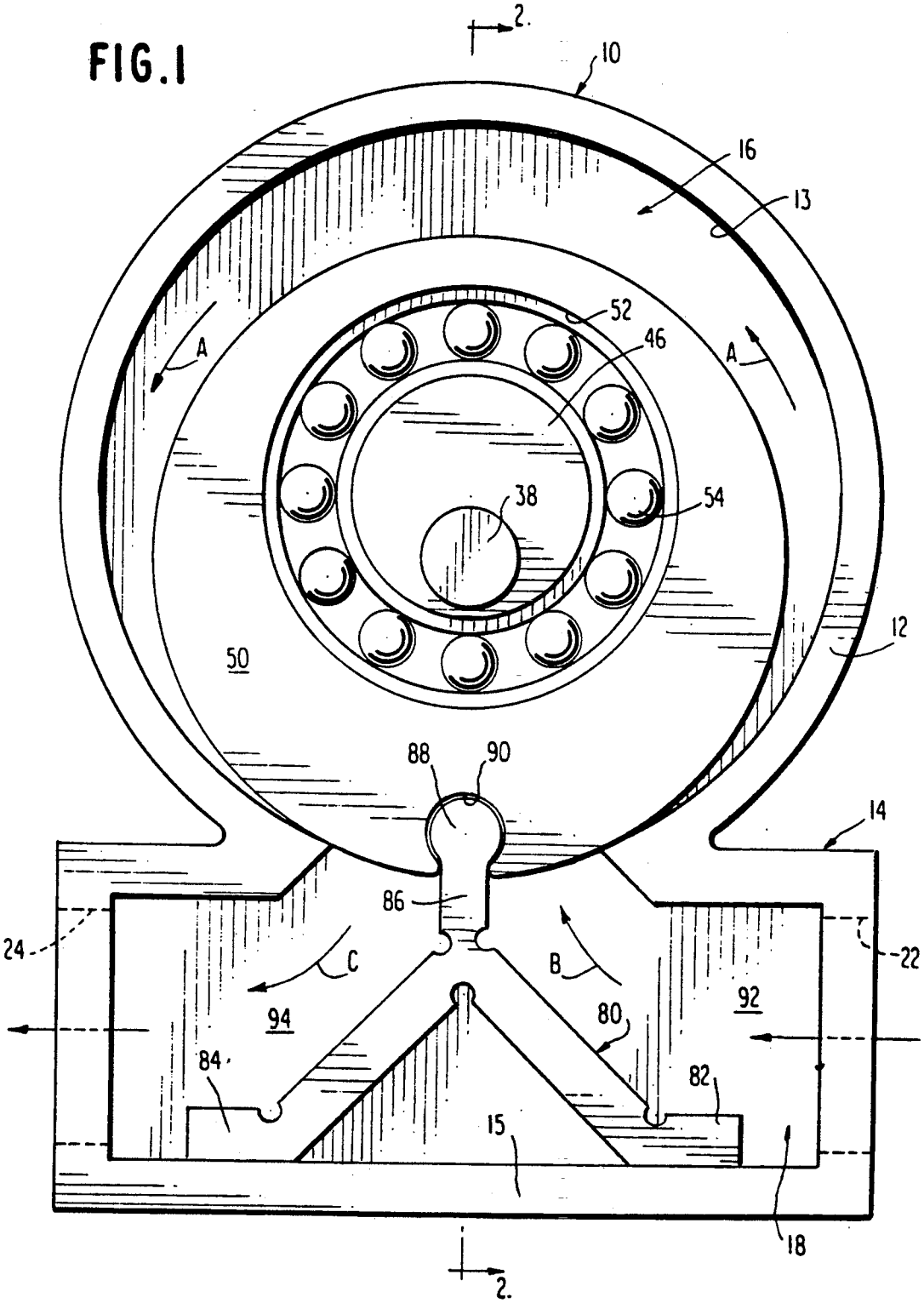
FIG. 1 is an end elevational view taken in the direction of arrow A in FIG. 2 of the pump according to the present invention with the end cover removed.
Figure 2:
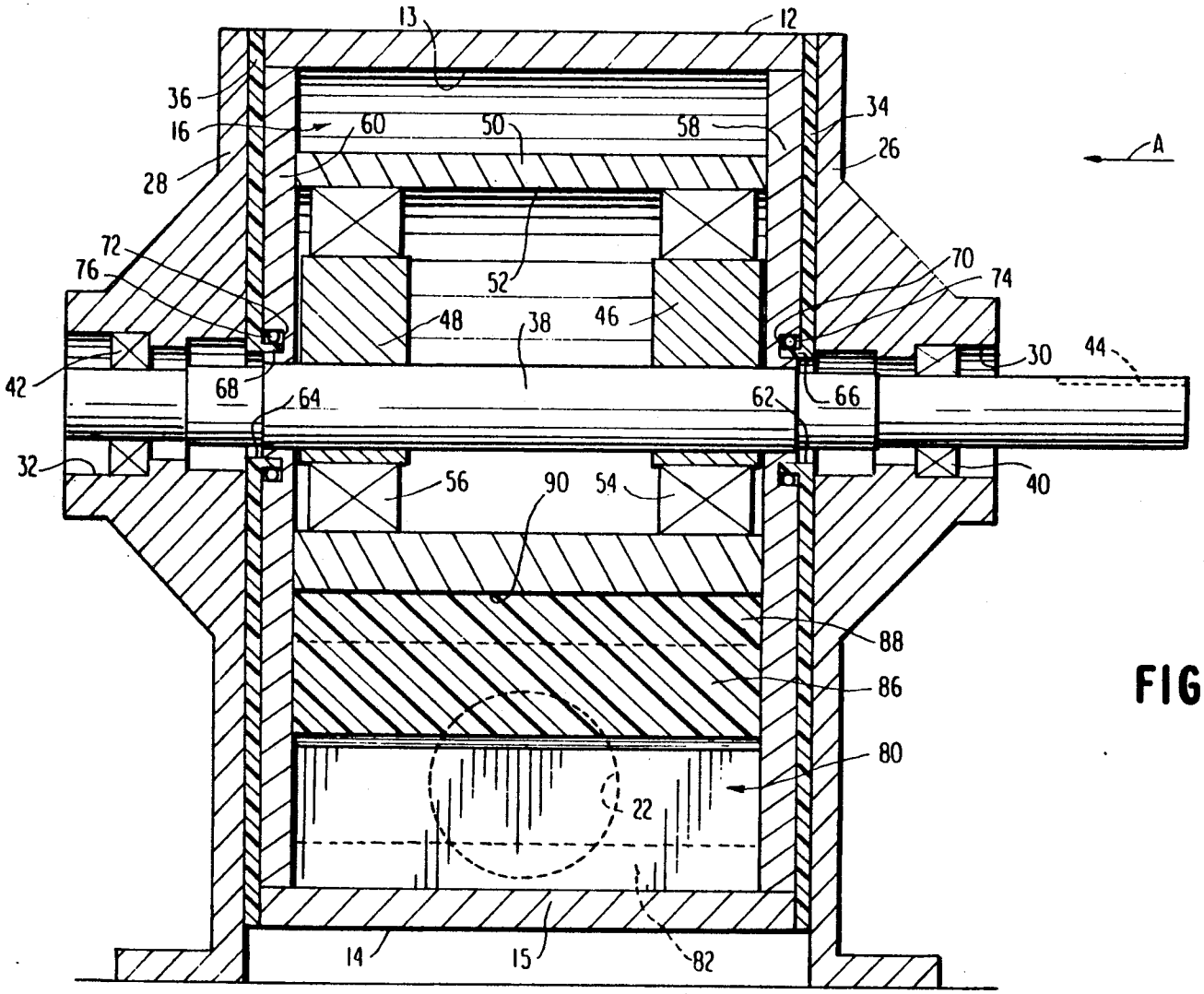
FIG. 2 is a partial sectional view taken along the line II—II in FIG. 1.
Figure 3:
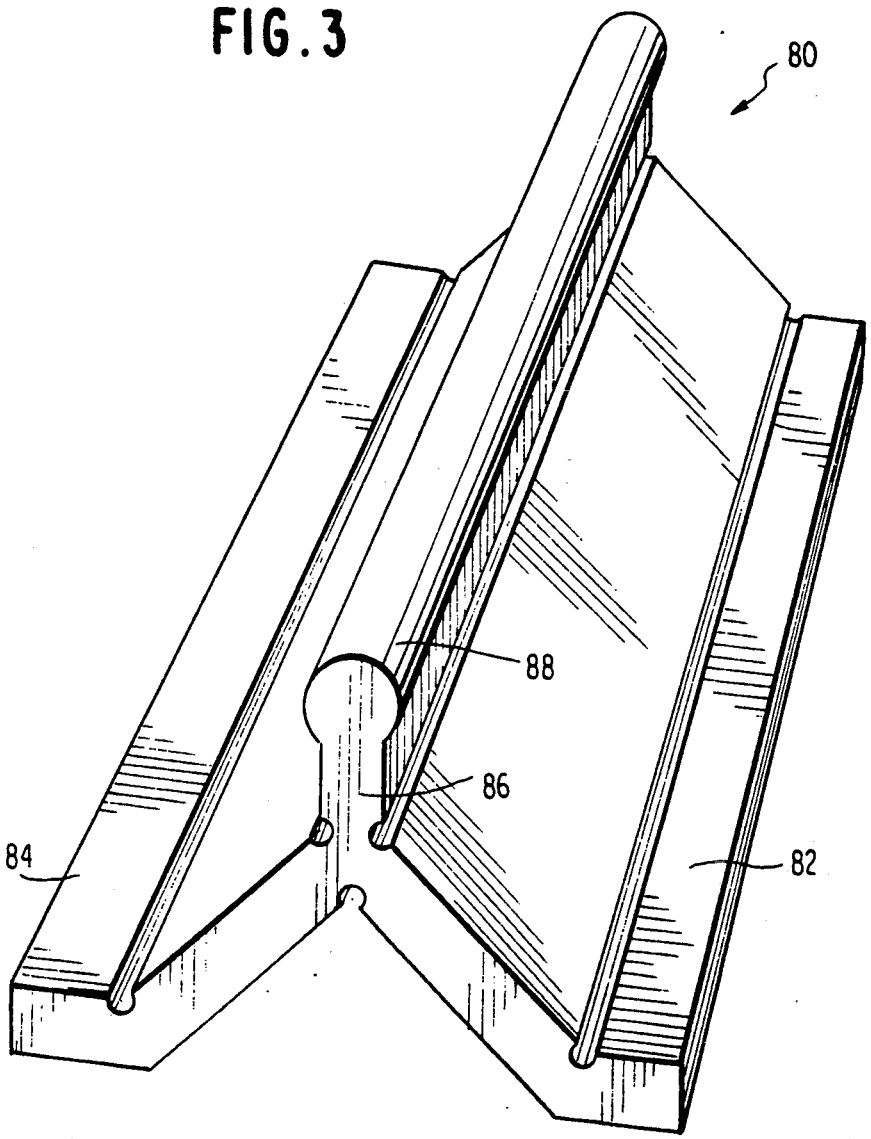
FIG. 3 is a perspective view of the elastic member for connecting the pumping member to the housing.

The pump according to the present invention is provided with a housing 10 comprised of an upper hollow cylindrical portion 12 and a substantially rectilinear lower portion 14. The upper and lower portions may be cast as a single piece from any suitable material. The cylindrical chamber 16 defined by the hollow cylindrical housing 12 and the chamber 18 defined by the rectilinear housing 14 are disposed in communication with each other by means of an elongated opening 20 extending the entire length of the housing 10. An inlet aperture 22 and an outlet aperture 24 are located in opposite sides of the lower housing portion and they are adapted to be provided with suitable fittings to provide for the inlet and outlet of fluid to and from the pump. The opposite ends of the housing 10 are closed by a pair of identical end covers 26 and 28 having aligned apertures 30 and 32 respectively. A pair of diaphragm type wear gaskets 34 and 36 are disposed adjacent each end cover 26 and 28 and are secured between the end covers and the housing 10 by any suitable means such as bolts or the like (not shown) which connect the covers to the housing.

A drive shaft 38 extends through the cylindrical chamber 16 and is rotatably mounted in the end cover plates 26 and 28 by means of bearings 40 and 42.

The one end of the shaft 38 is provided with a slot 44 to facilitate connection of the shaft to a suitable drive motor (not shown). A pair of eccentrics 46 and 48 are secured to the shaft for rotation therewith in spaced apart relation to each other. A cylindrical rotor or pumping member 50 is provided with a cylindrical bore 52 extending therethrough and having an axis parallel to but offset from the axis of the cylindrical rotor 50. The shaft 38 extends through the cylindrical bore 52 with the eccentrics 46 and 48 located within the bore adjacent opposite ends thereof. A pair of bearings 54 and 56 are disposed between the eccentrics 46 and 48 respectively and the interior surface of the cylindrical bore 52. A pair of wear plates 58 and 60 are disposed at opposite ends of the cylindrical member 50. Each gasket 34 and 36 is provided with a central aperture 62 to accomodate the shaft 36 and flanges 66 and 68 are provided about the apertures 62 and 64 and extend inwardly into annular grooves 70 and 72 formed in the wear plates 58 and 60 respectively. A pair of O ring seals 74 and 76 are disposed between the flanges 66 and 68 and the radially outer surface of the grooves 70 and 72.

An inverted Y-shape elastic divider 80 is mounted in the lower housing member 14 and extends lengthwise the entire length of the aperture 20 communicating the upper and lower chambers 16 and 18. The elastic divider 80 is provided with elongated feet 82 and 84 on each leg which are secured to the bottom wall 15 of the lower housing 14 by any suitable means (not shown). The upstanding leg 86 of the inverted Y-shaped elastic divider 80 is provided with an elongated enlarged head portion 88 which extends the entire length of the divider and which is securely fitted within a cylindrical recess 90 formed the entire length of the cylindrical rotor 50. The elastic divider 80 divides the lower chamber 18 into a fluid inlet chamber 92 and a fluid outlet chamber 94. Upon rotation of the shaft 38 the eccentrics 46 and 48 will cause the rotor 50 to move in substantially rolling contact with the interior surface 13 of the cylindrical housing 12. Since the rotor 50 is tethered to the housing by means of the elastic divider 80, the rotor does not rotate about its own axis but merely moves in a circular path in the direction of the arrows A. Such a motion entraps the fluid entering through the fluid inlet chamber 92 so that the fluid will be drawn upwardly from the lower chamber 18 to the upper chamber 16 in the direction of the arrow B. The fluid will be forced by the rolling motion of the rotor 50 about the internal periphery of the chamber 16 in the direction of the arrows A with the fluid being discharged into the fluid outlet chamber 94 in the direction of the arrow C. The arrangement of the wear gaskets 34 and 36 with the wear plates 58 and 60 having the O rings 70 and 72 therebetween eliminates the need for gaskets between the rotatable shaft and the housing.

The wear gaskets 34 and 36 may be of plastic materials having a low coefficiency of friction while providing operating capabilities over a wide temperature range. The flexibility and impermeability of polyurethane and silicon with high strength of synthetic fiber cloth inserts is recommended for service up to 300° F. Such material has excellent resistance to ozone. The fluid pump is designed as a fluid pump with capability of handling solid materials entrained in the fluid. The elastic divider may also be of suitable plastic material having a durometer of approximately 88 on the A scale and capable of an elongation of approximately 300%. However, the actual elongation of the elastic divider within the pump is in the range of 10% to 20%.

While the invention has been particularly shown and described with reference to a preferred embodiment thereof it will be understood by those in the art that various changes in form and detail may be made therein without departing from the spirit and scope of the invention.

What is claimed is:

1. An oscillatory pump comprising first housing means defining a horizontally disposed cylindrical chamber and second housing means defining a rectilinear chamber beneath said cylindrical chamber and in communication therewith, a cylindrical pumping member having an elongated horizontally disposed axis located in said cylindrical chamber and having a diameter less than said cylindrical chamber, elastic means secured to said second housing means in said rectilinear chamber and connected to said cylindrical pumping member along the length thereof to prevent rotation of said pumping member about its horizontal axis while permitting said cylindrical pumping member to move about an internal surface of said cylindrical chamber, said cylindrical pumping member having an eccentric bore extending therethrough, a rotatable drive shaft extending through said cylindrical chamber and said eccentric bore with opposite ends supported by said first housing means, eccentric means disposed on said shaft, bearing means disposed between said eccentric means and said eccentric bore whereby upon rotation of said shaft, the rotation of said eccentric means about the axis of said shaft will cause said pumping member to move in a substantially circular path about the internal surface of said cylindrical chamber and fluid inlet and outlet means located in said second housing means and disposed in communication with said rectilinear chamber on opposite sides of said elastic means;

wherein said elastic means is comprised of an elongated elastic member having an inverted Y-shaped configuration with an upstanding leg and two downwardly angularly disposed legs connected to said upstanding leg at a common point, said upstanding leg having connecting means for connecting said upstanding leg to said pumping member and means for securing lower ends of said angularly disposed legs to a bottom wall of said first housing means, said common point between said legs being disposed between said means for securing lower ends of said angularly disposed legs to said bottom wall and said pumping member at all times.

2. An oscillatory pump as defined in claim 1, wherein said first and second housing means have common end plates disposed at opposite ends of said first and second housing means to close said cylindrical chamber and said rectilinear chamber, gasket means substantially coextensive with said end plates and secured between said end plates and said first and second housing means and wear plate means disposed between opposite ends of said pumping member and said gasket means;

said gasket means and said wear plate means having aligned apertures for said drive shaft with sealing means spaced from said shaft disposed between said gasket means and said wear plate means.

* * * * *